US006935899B2

(12) United States Patent
Lee

(10) Patent No.: US 6,935,899 B2
(45) Date of Patent: Aug. 30, 2005

(54) ELECTRICAL CONNECTOR HAVING IMPROVED CONTACT

(75) Inventor: Wei-Chen Lee, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/750,095

(22) Filed: Dec. 31, 2003

(65) Prior Publication Data

US 2005/0142948 A1 Jun. 30, 2005

(51) Int. Cl.[7] ..... H01R 24/00
(52) U.S. Cl. ..... 439/630
(58) Field of Search ..... 439/630, 660, 439/635, 260, 637

(56) References Cited

U.S. PATENT DOCUMENTS 3,673,548 A * 6/1972 Mattingly et al. ..... 439/637
4,795,374 A 1/1989 Rishworth et al.
5,052,936 A * 10/1991 Biechler et al. ..... 439/60
6,210,177 B1 4/2001 Huang et al.

* cited by examiner

*Primary Examiner*—Phuong Dinh
(74) *Attorney, Agent, or Firm*—Wei Te Chung

(57) ABSTRACT

An electrical connector (1) includes an insulative housing (10) defining a mating port (11) and a number of passageways (14) communicating with the mating port, and a number of contacts (20) received in the passageways of the insulative housing. Each of the contacts includes a retention portion (21) retained in a corresponding passageway of the insulative housing, a resilient arm (22) extending from the retention portion, an abutting portion (23) abutting against an inner wall (17) of the corresponding passageway for pre-loading the contact, and a contact portion (24) extending from the abutting portion and exposed into the mating port of the insulative housing. The abutting portion is deflectable away from the inner wall of the corresponding passageway together with the contact portion.

2 Claims, 9 Drawing Sheets

ELECTRICAL CONNECTOR HAVING IMPROVED CONTACT

BACKGROUND OF THE INVENTION

1. Field of the Invention

The present invention relates to an electrical connector, and particularly to an electrical connector for signal transmission between two separated circuit boards.

2. Description of Related Art

Card edge connectors are widely used to connect daughter cards or other similar electronic components with mother boards. Referring to FIGS. 7–9, a conventional card edge connector 100 for connecting a daughter card 200 with a mother board 300 includes an elongate housing 101 and a plurality of contacts 102. The housing 101 defines a mating port 103 and a plurality of apertures 104 in a front face thereof, and a plurality of passageways 105 communicating with the mating port 103 and the apertures 104. Each of the contacts 102 includes a retention portion 106 received in a slot 111 communicating with a corresponding one of the passageways 105, a resilient arm 107 forwardly and downwardly extending from the retention portion 106 and received in the corresponding one of the passageways 105, a curved portion 108 extending from the resilient arm 107 and exposed into the mating port 103 to function as a contact portion, a distal end 109 bent from the curved portion 108 and received in a corresponding aperture 104, and a tail portion 112 downwardly and rearwards extending from the retention portion 106 and soldered to a solder pad 301 of the mother board 300. In order to increase the mating force between the curved portions 108 of the contacts 102 and conductive pads 201 of the daughter card 200 for ensuring a reliable electrical connection therebetween, the distal ends 109 of the contacts 102 are usually preloaded by a support portion 110 of the housing 101.

However, since the distal ends 109 of the contacts 102 exert reaction force on the support portion 110, a middle portion of the housing 101 above the mating port 103 will sag due to the elevated temperature during the reflow process of connecting the contacts 102 to the mother board 300. The elevated temperature results in tending to close the mating port 103, thereby damaging the card edge connector 100 (shown in phantom lines in FIG. 7). A solution for the above problem is to put a cover 400 in the mating port 103 to support the support portion 110 during the reflow process. Nevertheless, the additional cover 400 increases the cost of the card edge connector 100. In addition, the cover 400 has to be removed before the insertion of the daughter card 200 into the mating port 103 of the card edge connector 100, thereby complicating the assembly of the card edge connector 100 and the daughter card 200.

Hence, an improved electrical connector is required to overcome the disadvantages of the conventional card edge connector.

SUMMARY OF THE INVENTION

An object of the present invention is to provide an electrical connector having improved contacts which can prevent the insulative housing thereof from deforming.

To achieve the above object, an electrical connector in accordance with the present invention comprises an insulative housing defining a mating port and a plurality of passageways communicating with the mating port, and a plurality of contacts received in the passageways of the insulative housing. Each of the contacts comprises a retention portion retained in a corresponding passageway of the insulative housing, a resilient arm extending from the retention portion, an abutting portion abutting against an inner wall of the corresponding passageway for pre-loading the contact, and a contact portion extending from the abutting portion and exposed into the mating port of the insulative housing. The abutting portion is deflectable away from the inner wall of the corresponding passageway together with the contact portion.

Other objects, advantages and novel features of the invention will become more apparent from the following detailed description when taken in conjunction with the accompanying drawings.

DETAILED DESCRIPTION OF THE INVENTION

Figure 1:
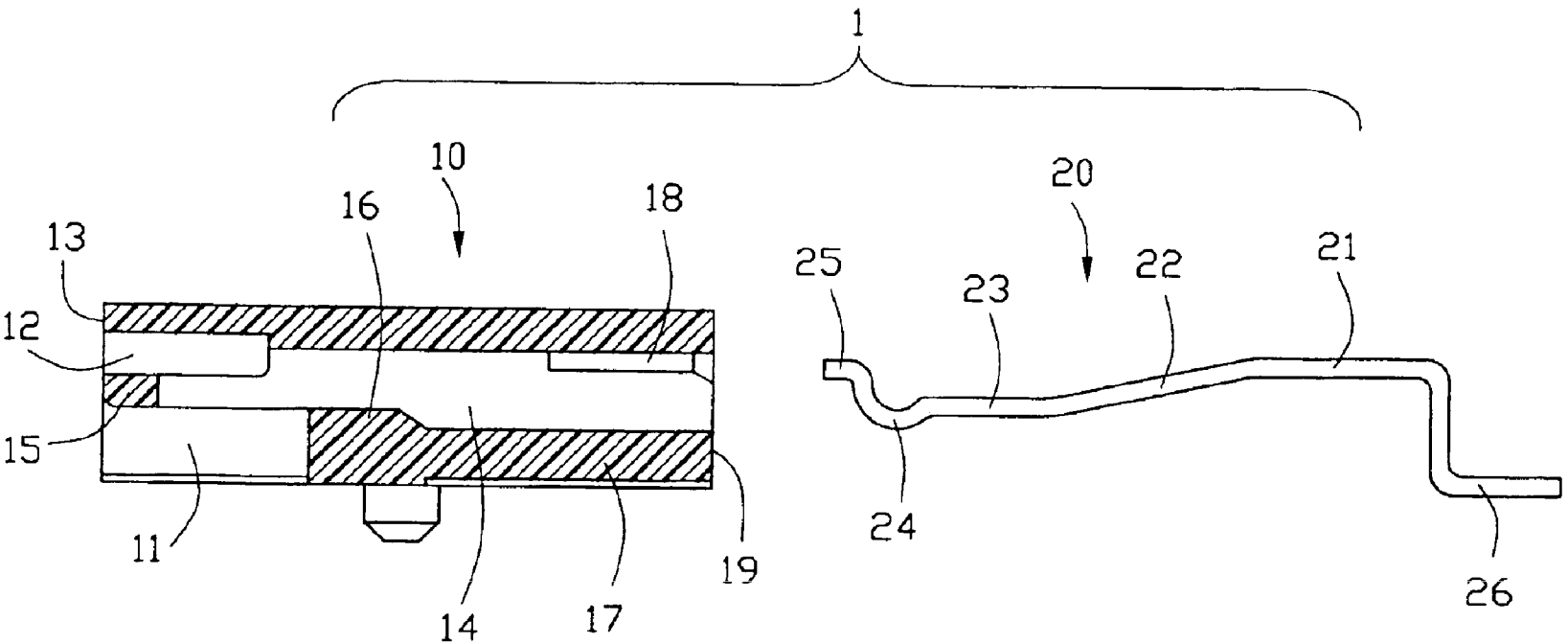
FIG. 1 is an exploded cross-sectional view of an electrical connector in accordance with of a first embodiment of the present invention.

Referring to FIG. 1, an electrical connector 1 in accordance with a first embodiment of the present invention comprises an insulative housing 10 and a plurality of contacts 20 (only one shown received in the insulative housing 10).

Figure 5:
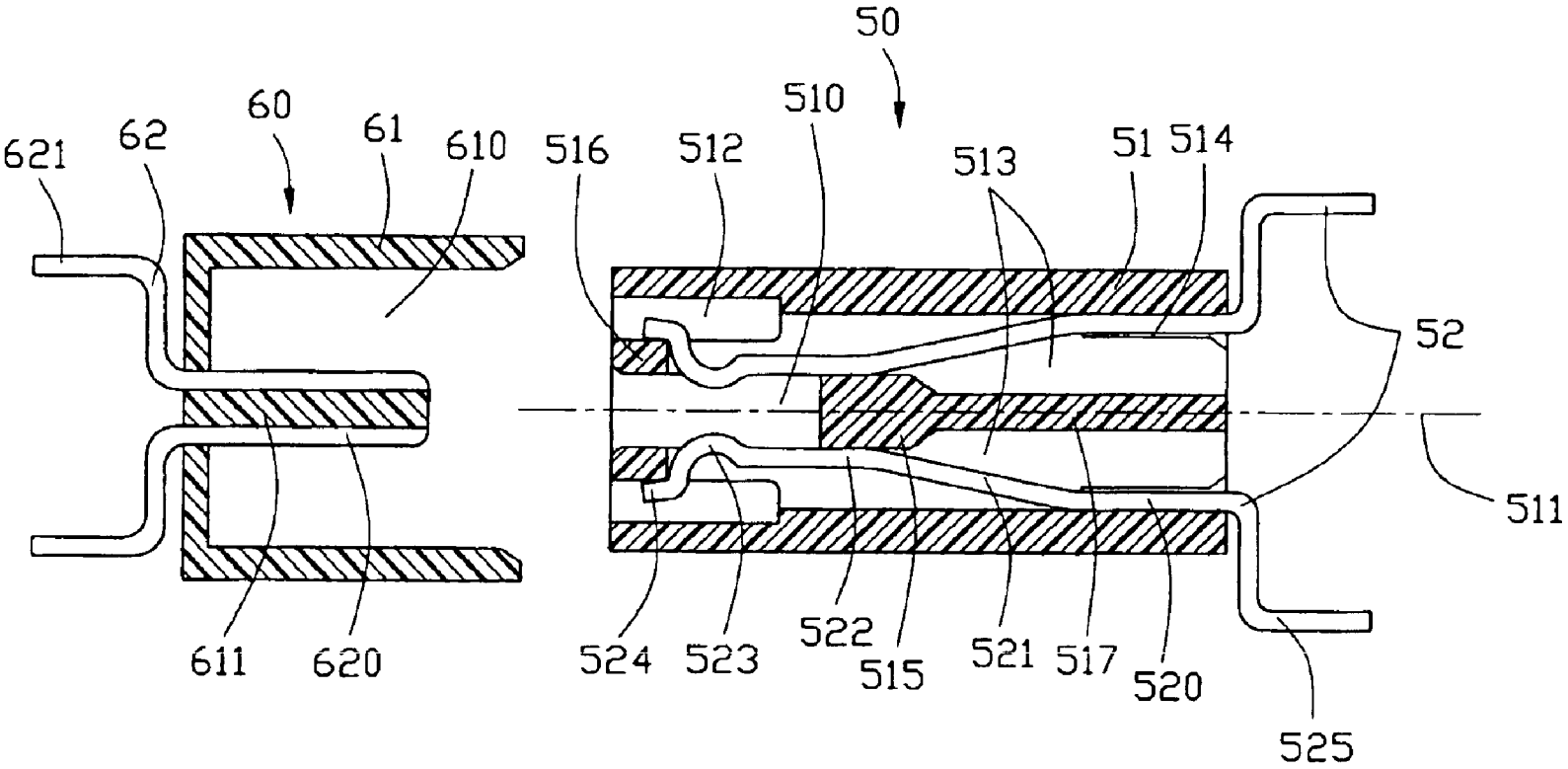
FIG. 5 is a cross-sectional view of an electrical connector in accordance with a third embodiment of the present invention and showing a complementary connector for mating with the electrical connector.

The insulative housing 10 is similar to the housing 101 of the of the conventional card edge connector 100 of FIG. 5 and also defines a mating port 11 and a plurality of apertures 12 in a front face 13 thereof. The apertures 12 are located over the mating port 11 and a plurality of blocks 15 are formed therebetween. A plurality of passageways 14 extend forwardly from a rear face 19 of the insulative housing 10 and each communicates with a corresponding aperture 12 and the mating port 11. A plurality of clumps 16 upwardly project into the passageways 14 from front ends of inner walls 17 which face the passageways 14. A pair of slots 18 (only one shown) are defined in opposite sides of each of the passageways 14.

Each of the contacts 20 comprises a retention portion 21, a resilient arm 22 extending forwardly and downwardly from the retention portion 21, an abutting portion 23 extending forwardly from the resilient arm 22, a curved contact portion 24 extending from the abutting portion 23, a distal end 25 bent from the contact portion 24, and a tail portion 26 downwardly and rearwards extending from the retention portion 21.

Figure 2:
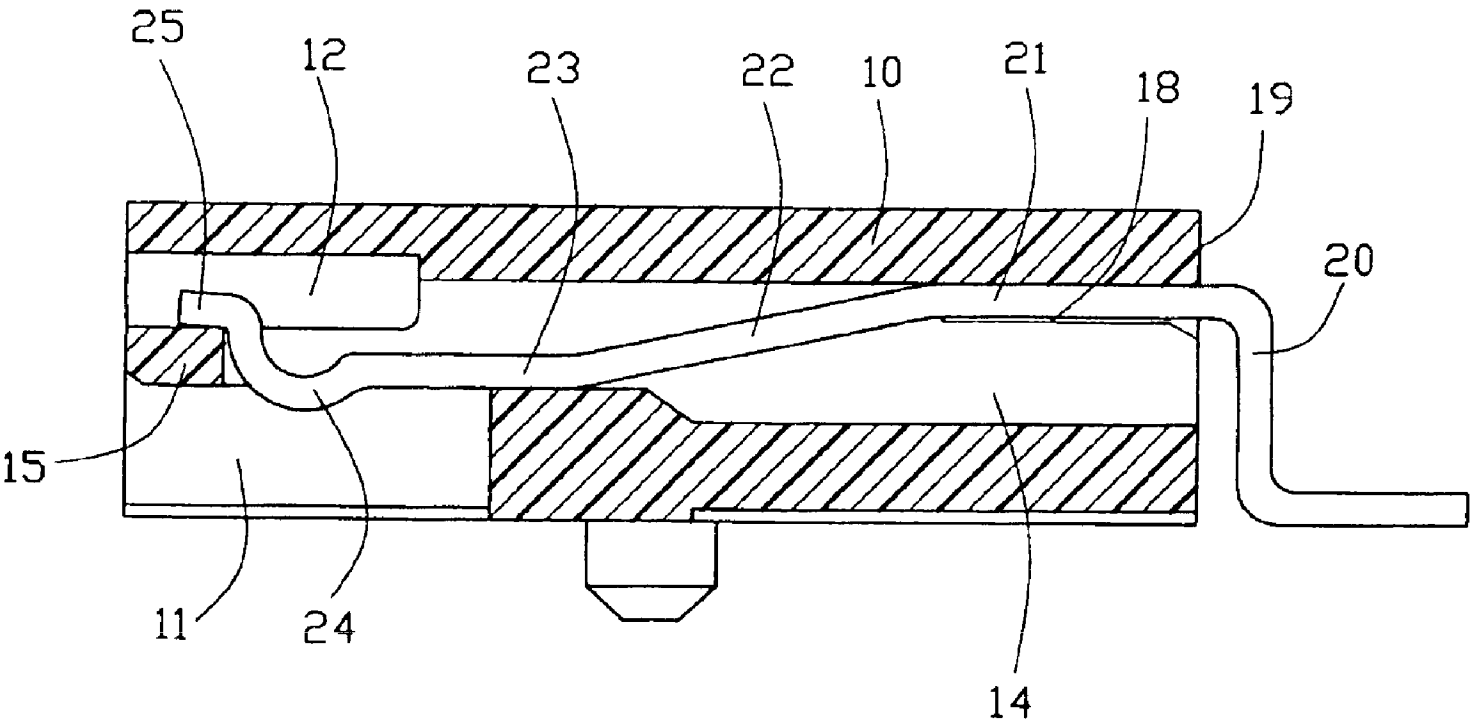
FIG. 2 is an assembled cross-sectional view of the electrical connector of FIG. 1.
Figure 3:
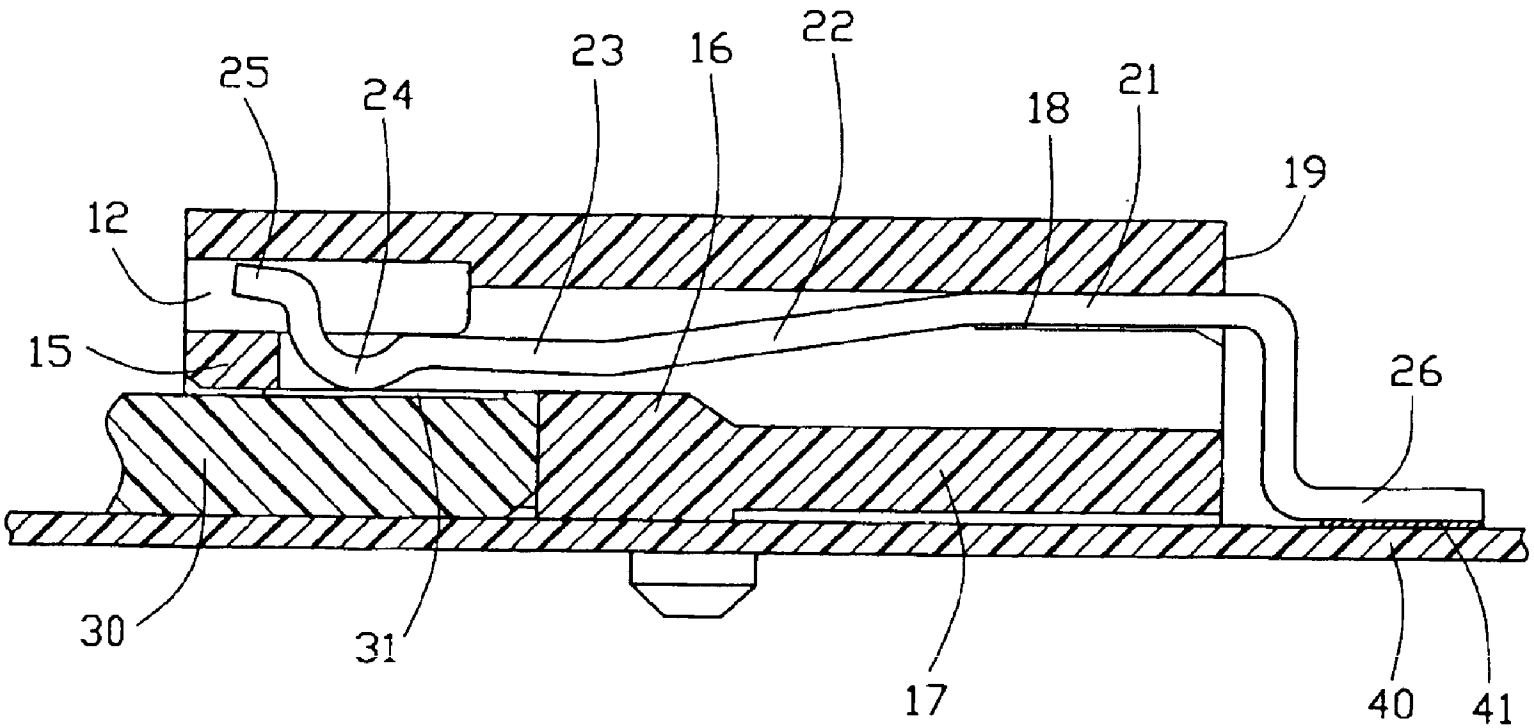
FIG. 3 is a view similar to FIG. 2 but showing the electrical connector mounted on a mother board and mating with a daughter card.

Referring to FIGS. 2 and 3, in assembly, the contacts 20 are assembled into the insulative housing 10 from the rear face 19 thereof. The retention portions 21 are received in the slots 18 for securing the contacts 20 in the passageways 14 of the insulative housing 10. The abutting portions 23 abut against the clumps 16 for upwardly pre-loading the contacts 20. The contact portions 24 are exposed into the mating port 11 of the insulative housing 10 for contacting with conductive pads 31 of a daughter card 30. The distal ends 25 are received in the apertures 12. The tail portions 26 extend beyond the rear face 19 of the insulative housing 10 for being soldered to solder pads 41 of a mother board 40 on which the electrical connector 1 is mounted. The abutting portions 23 of the contacts 20 are deflectable away from the inner walls 17 together with the contact portions 24 and the distal ends 25. Since the abutting portions 23 of the contacts 20 are pre-loaded by the clumps 16 of the inner walls 17, there is no reaction force exerted on the blocks 15 of the insulative housing 10 and the reaction force of the abutting portions 23 is exerted on the inner walls 17 which seats on the mother board 40, so no deformation of the insulative housing 10 will occur during the reflow process of connecting the tail portions 26 of the contacts 20 to the solder pads 41 of the mother board 40. When the daughter card 30 is inserted into the mating port 11 of the electrical connector 1, the daughter card 30 presses against the contact portions 24 of the contacts 20 to upwardly deflect the contact portions 24 and to separate the abutting portions 23 from the clumps 16 for ensuring a reliable electrical connection between the electrical connector 1 and the daughter card 30.

Figure 4:
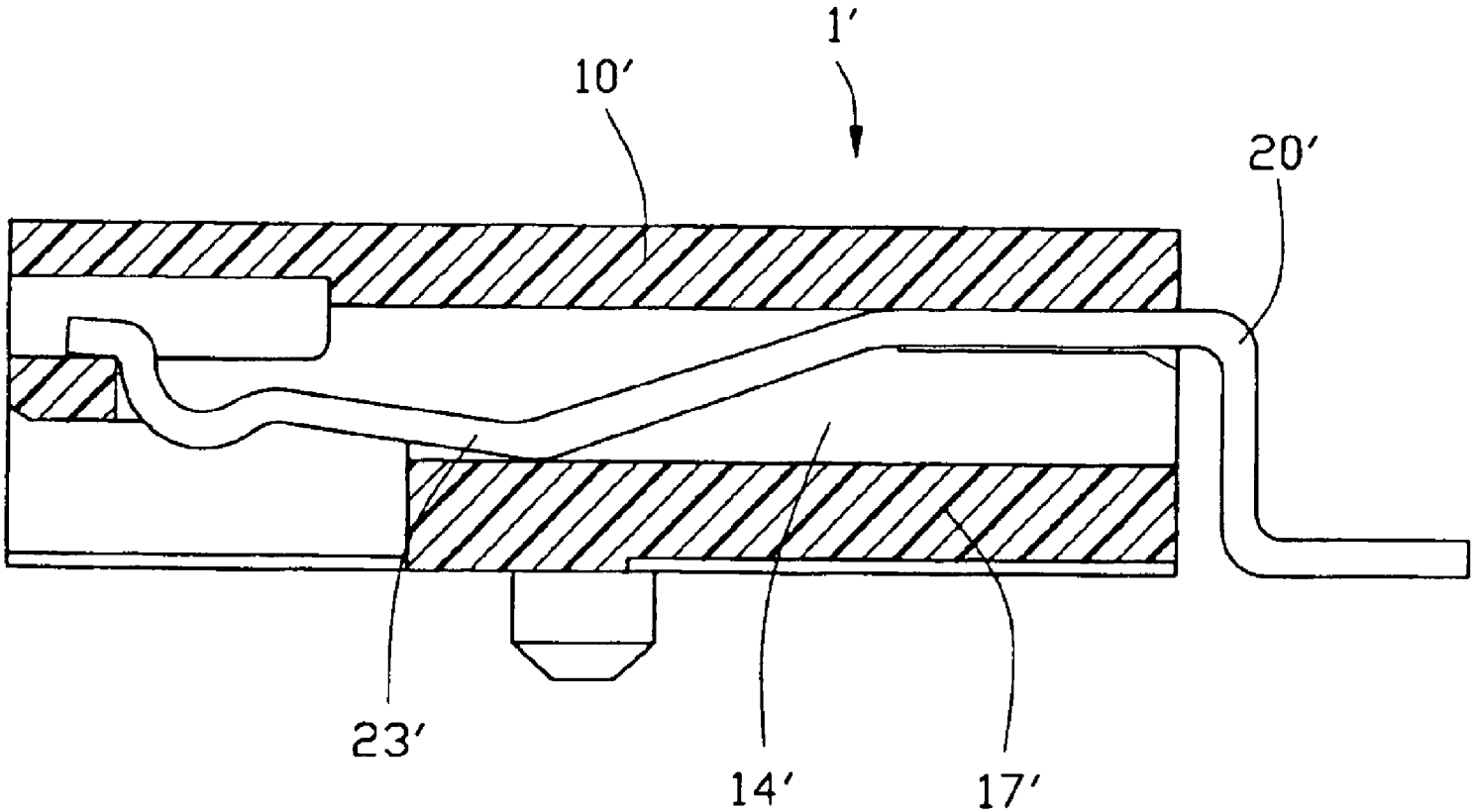
FIG. 4 is an exploded cross-sectional view of an electrical connector in accordance with a second embodiment of the present invention.

Referring to FIG. 4, an electrical connector 1' in accordance with a second embodiment of the present invention is identical with the electrical connector 1 in accordance with the first embodiment in configuration and structure except that there is no clumps formed on inner walls 17' of the passageways 14' of the insulative housing 10' thereof. Abutting portions 23' of contacts 20' directly abut against the inner walls 17' of the passageways 14' for upwardly pre-loading the contacts 23'.

Referring to FIG. 5, an electrical connector 50 in accordance with a third embodiment of the present invention and a complementary connector 60 are disclosed. The electrical connector 50 comprises an insulative housing 51 and a plurality of pairs of contacts 52 (only one pair shown) received in the insulative housing 51. The insulative housing 51 defines a mating port 510 in a center thereof, a plurality of pairs of apertures 512 (only one pair shown), and a plurality of pairs of passageways 513 (only one pair shown) each pair communicating with a corresponding pair of apertures 512 and the mating port 510. The insulative housing 51 defining a central line 511 in mating direction thereof. Each of the pairs of the apertures 512 and the passageways 513 are both symmetrically arranged at opposite sides of the central line 511. Each of the pairs of the contacts 52 are received in a corresponding pair of the passageways 513 and are symmetrically arranged with each other. Each of the contacts 52 comprises a retention portion 520 received in a pair of slots 514 (only one shown) which are defined in opposite sides of each of the passageways 513, a resilient arm 521 extending from the retention portion 520, an abutting portion 522 extending forwardly from the resilient arm 521 and abutting against a clump 515 formed on an inner wall 517 between each of the pairs of the passageways 513 for pre-loading the contact 52, a contact portion 523 extending from the abutting portion 522 and being exposed into the mating port 510, a distal end 524 bent from the contact portion 523 and being received in a corresponding aperture 512, and a tail portion 525 laterally and rearwards extending from the retention portion 520 for mounting to a mother board (not shown). Since there is no reaction force exerting on blocks 516 of the insulative housing 51 and two reaction forces, which are equal and opposite to each other, of the two abutting portions 522 of the two contacts 52 received in one of the pairs of passageways 513 are exerted on the inner wall 517 between the one of the pairs of passageways 513, no deformation of the insulative housing 51 will occur during reflow process.

The complementary connector 60 comprises a housing 61 defining a cavity 610, and a plurality of terminals 62 (only one pair shown). A mating plate 611 extends into the cavity 610 of the housing 61. The terminals 62 are disposed on opposite sides of the mating plate 611 of the housing 61 and each comprises a contact portion 620 and a tail portion 621 laterally and rearwards extending from the contact portion 620 for mounting to a daughter board (not shown). When the electrical connector 50 is mating with the complementary connector 60. The insulative housing 51 is partially inserted into the cavity 610 of the housing 61 of the complementary connector 60. The mating plate 611 of the housing 61 is inserted into the mating port 510 of the insulative housing 51 of the electrical connector 50. The contact portions 620 of the terminals 62 press against the contact portions 523 of the contacts 52 to laterally deflect the contact portions 523 and to separate the abutting portions 522 from the clumps 515 of the inner walls 517 between the pairs of the passageways 513 for ensuring a reliable electrical connection between the electrical connector 50 and the complementary connector 60.

Figure 6:
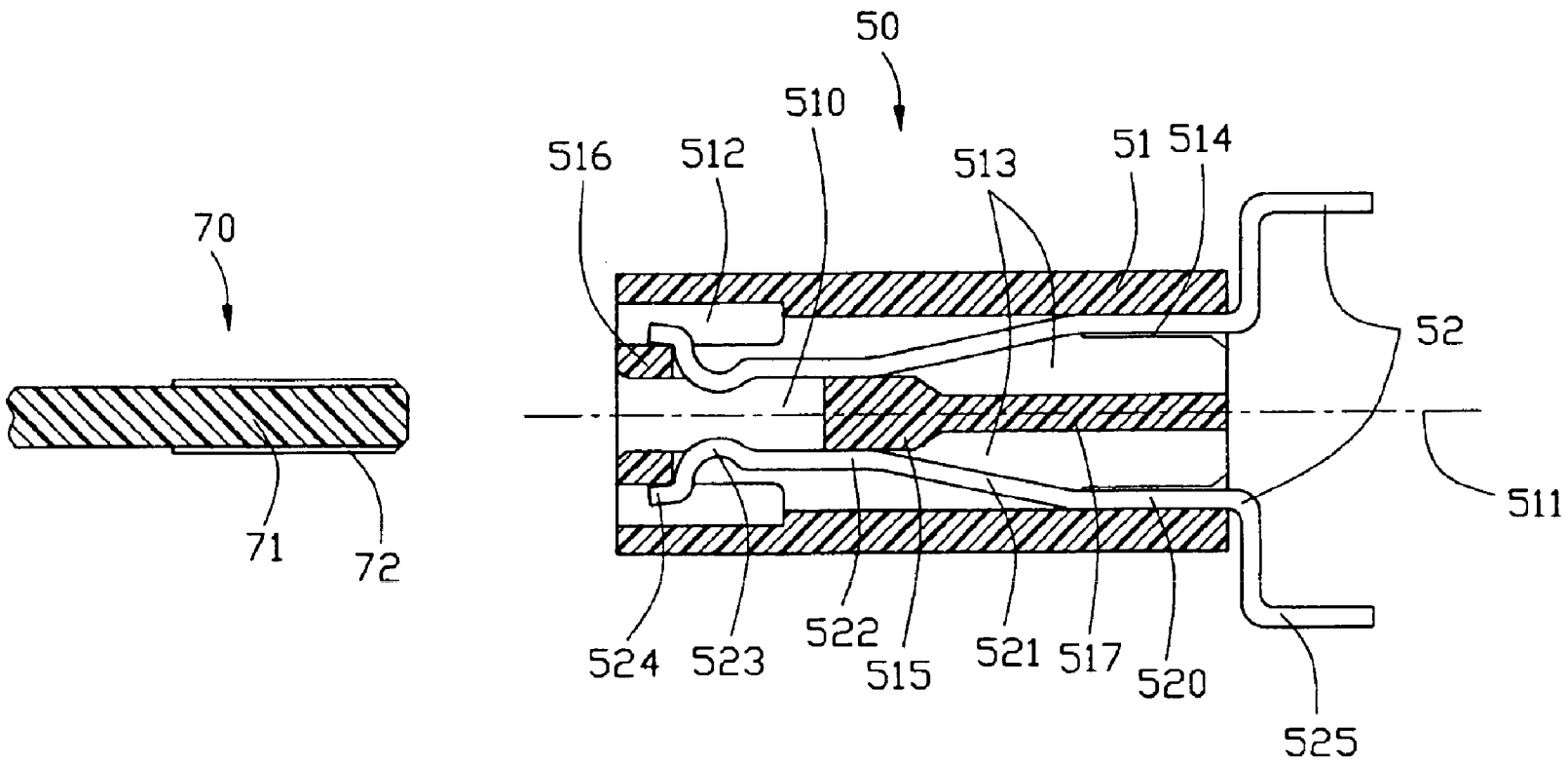
FIG. 6 is a cross-sectional view of the electrical connector of FIG. 5 and showing a daughter card for mating with the electrical connector.
Figure 7:
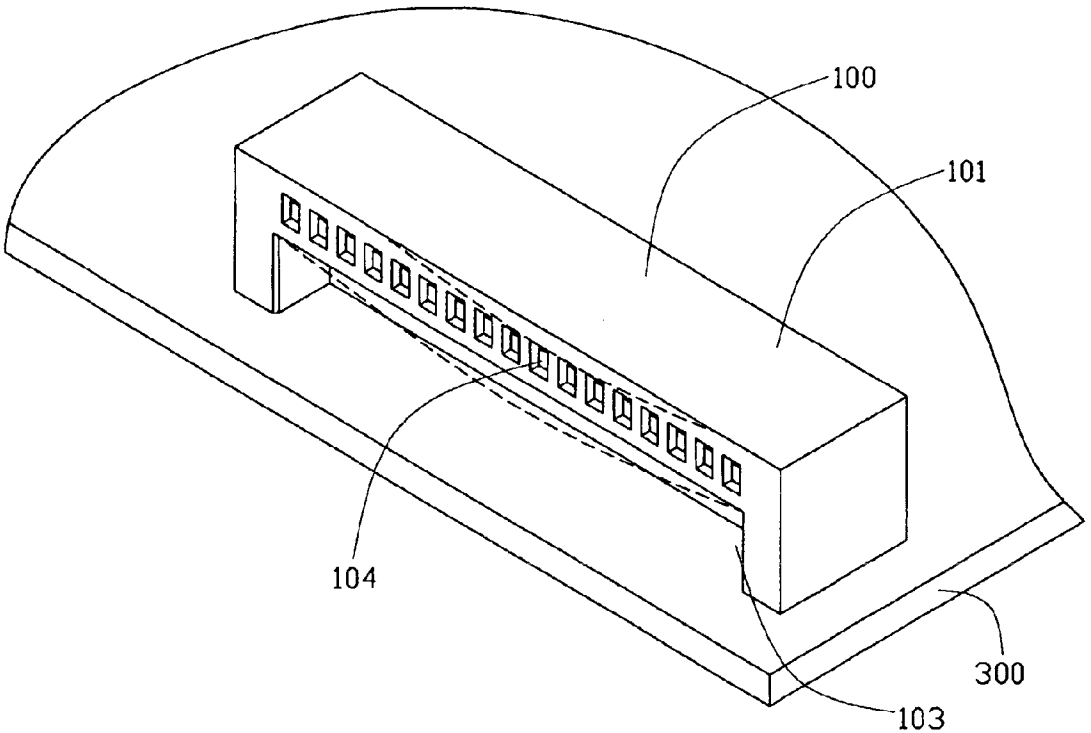
FIG. 7 (PRIOR ART)
FIG. 7 is a perspective view of a conventional card edge connector which is mounted on a mother board.
Figure 8:
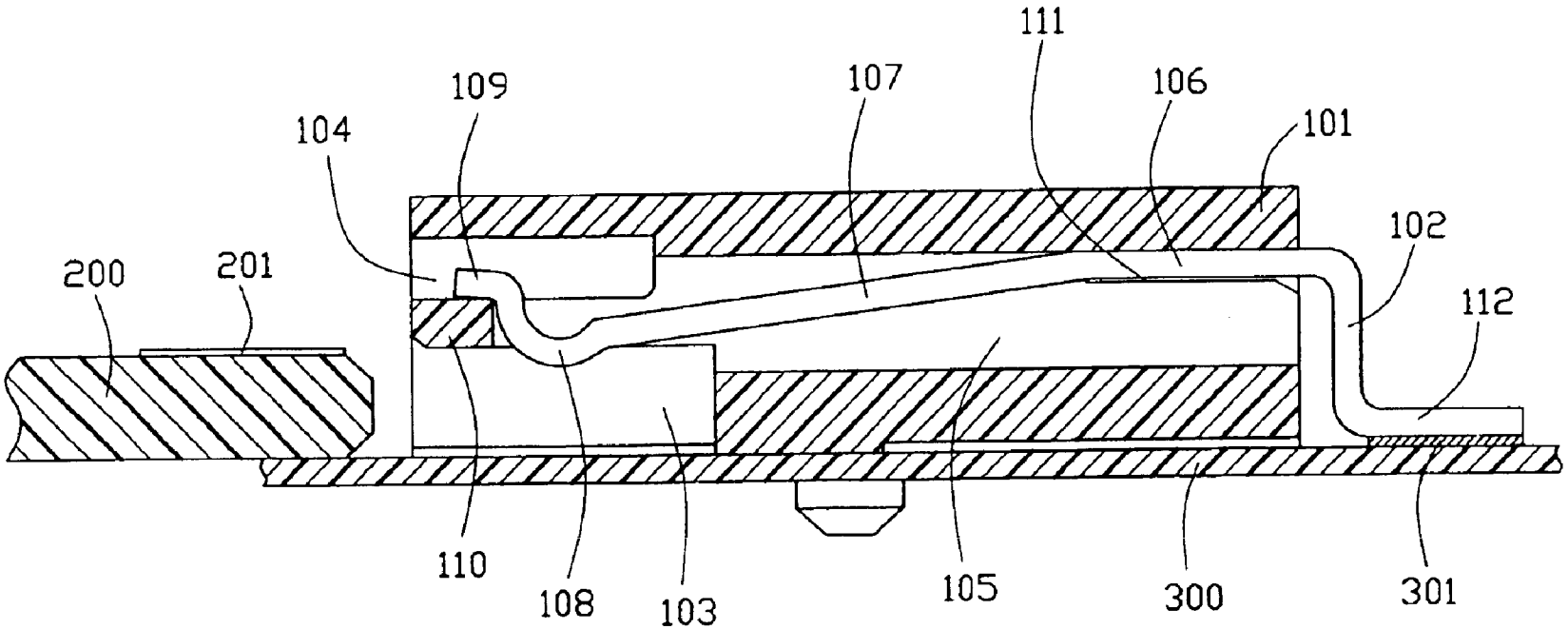
FIG. 8 (PRIOR ART)
FIG. 8 is a cross-sectional view of FIG. 7 and showing a daughter card for mating with the card edge connector.
Figure 9:
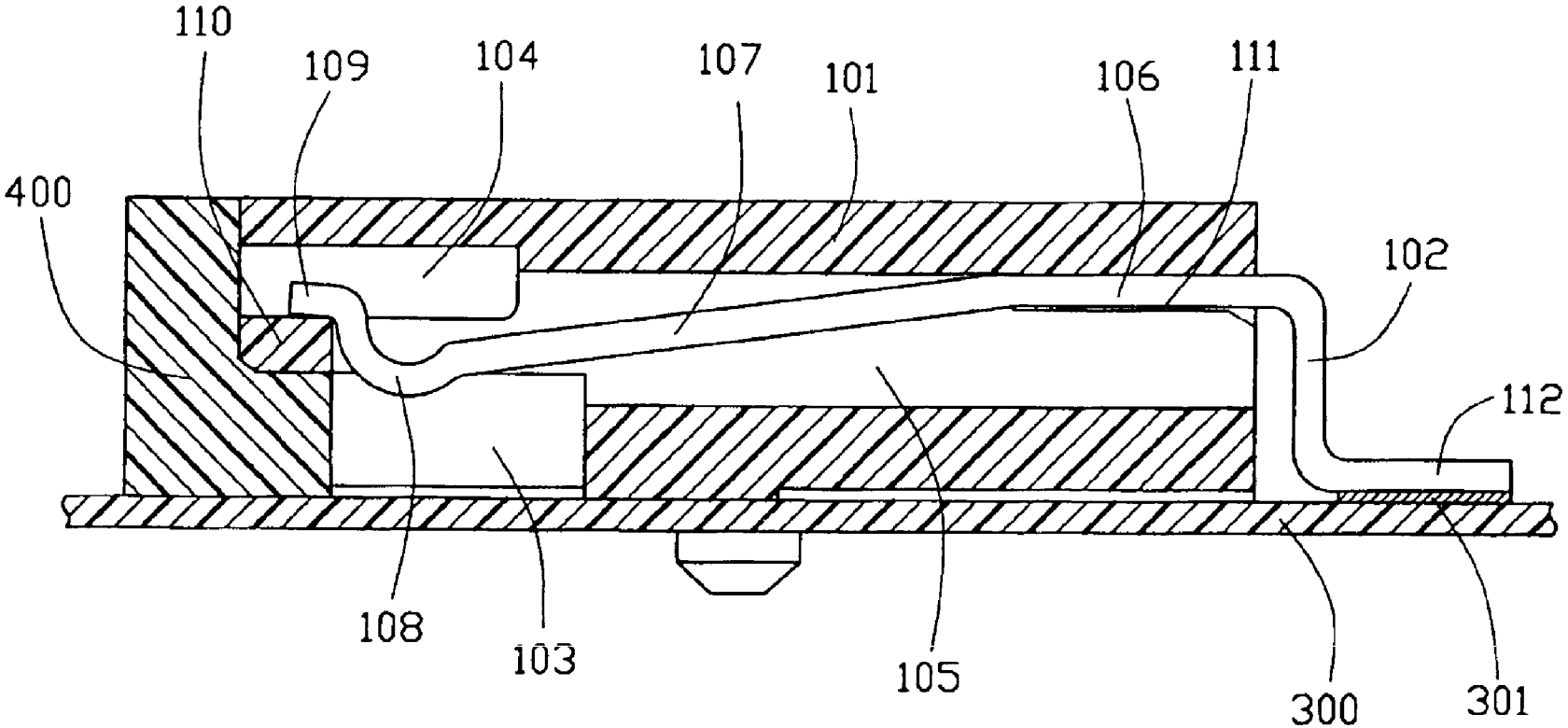
FIG. 9 (PRIOR ART)
FIG. 9 is a cross-sectional view of FIG. 7 and showing a cover inserted into the card edge connector.

Referring to FIG. 6, the electrical connector 50 in accordance with a third embodiment of the present invention may be used to mate with a daughter card 70. The daughter card 70 includes a mating edge 71 having a plurality of conductive pads 72 arranged on opposite sides thereof. When the electrical connector 50 is mating with the daughter card 70. The mating edge 71 of the daughter card 70 is inserted into the mating port 510 of the insulative housing 51 of the electrical connector 50. The conductive pads 72 press against the contact portions 523 of the contacts 52 to laterally deflect the contact portions 523 and to separate the abutting portions 522 from the clumps 515 of the inner walls 517 between the pairs of the passageways 513 for ensuring a reliable electrical connection between the daughter card 70 and the electrical connector 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mating port and a pluruality of passageways communicating with the mating port; and a plurality of contacts received in the passageways of the insulative housing, each of the contacts comprising a retention portion retained in a corresponding passageway, a resilient arm extending from the retention portion, an abutting portion extending from the resilient arm and abutting against an inner wall of the corresponding passageway for pre-loading the contact, and a contact portion extending from the abutting portion and exposed into the mating port, the abutting portion being deflectable away from the inner wall together with the contact portion; wherein the insulative housing defines a corresponding number of apertures communicating with the mating port and the passageways, and wherein each of the contacts comprises a distal end bent from the contact portion and received in a corresponding aperture; wherein the insulative housing defines a pair of slots in opposite sides of each of the passageways for receiving the retention portion of the contact; wherein each of the contacts comprise a tail portion extending from the retention portion beyond the insulative housing for being soldered to a mother board; wherein the inner wall of the corresponding passageway is formed with a clump pressing the abutting portion of the contact; wherein the insulative housing defines a central line in a mating direction thereof, wherein the passageways are symmetrically arranged at opposite sides of the central line in pairs, and wherein the contacts are symmetrically received in the pairs of the passageways.

2. An electrical connector assembly, comprising:

an electrical connector comprising:

an insulative housing defining a mating port and a plurality of pairs of passageways symmetrically arranged on opposite sides of and in communication with the mating port; and a plurality of pairs of contacts symmetrically received in the pairs of the passageways of the insulative housing, each of the contacts comprising an abutting portion abutting against an inner wall between each of pairs of the passageways for pre-loading the contact, and a contact portion extending from the abutting portion and exposed into the mating port of the insulative housing; and a complementary component comprising an insulative mating portion, and a plurality of conductors disposed on opposite sides of the mating portion; wherein when the electrical connector mates with the complementary component, the mating portion of the complementary component is inserted into the mating port of the electrical connector, the conductors of the complementary component press against the contact portions of the contacts of the electrical connector for deflecting the contact portions and to separate the abutting portions away from the inner walls between the pairs of the passageways; wherein the inner wall of the corresponding passageway is formed with a clump pressing the abutting portion of the contact; wherein the complementary component comprises a housing defining a cavity partially receiving the insulative housing of the electrical connector.

* * * * *